US006792731B2

(12) United States Patent
Bott et al.

(10) Patent No.: US 6,792,731 B2
(45) Date of Patent: Sep. 21, 2004

(54) REINFORCING SYSTEM FOR STACKABLE RETAINING WALL UNITS

(76) Inventors: Timothy A. Bott, 4 Roanoke Rd., Sunfish Lake, MN (US) 55118; Robert A. Gravier, 4909 Bywood W. Rd., Edina, MN (US) 55439

( * ) Notice: Subject to any disclaimer, the term of this patent is extended or adjusted under 35 U.S.C. 154(b) by 0 days.

(21) Appl. No.: 10/224,914

(22) Filed: Aug. 21, 2002

(65) Prior Publication Data

US 2003/0213203 A1 Nov. 20, 2003

Related U.S. Application Data

(63) Continuation-in-part of application No. 09/976,384, filed on Oct. 11, 2001.

(51) Int. Cl.[7] ..... E02D 5/00

(52) U.S. Cl. ..... 52/603; 52/604; 52/606; 405/284; 405/262

(58) Field of Search ..... 405/262, 284, 405/286; 52/596, 604, 605, 606, 607, 603

(56) References Cited

U.S. PATENT DOCUMENTS

| | | | | |
|---|---|---|---|---|
| RE28,977 | E | 9/1976 | Mason | |
| 4,050,254 | A | 9/1977 | Meheen et al. | |
| 4,266,890 | A | 5/1981 | Hilfiker | |
| 4,391,557 | A | 7/1983 | Hilfiker et al. | |
| 4,703,602 | A | 11/1987 | Pardo | |
| 4,728,227 | A | 3/1988 | Wilson et al. | |
| 4,909,010 | A | 3/1990 | Gravier | |
| 4,952,098 | A | 8/1990 | Grayson et al. | |
| 5,028,172 | A | 7/1991 | Wilson et al. | |
| 5,046,898 | A | 9/1991 | McKinney | |
| 5,066,169 | A | 11/1991 | Gavin et al. | |
| 5,127,770 | A | 7/1992 | Ditcher et al. | |
| 5,326,193 | A | 7/1994 | Peterson | |
| 5,468,098 | A | 11/1995 | Babcock | |
| 5,484,235 | A | 1/1996 | Hilfiker et al. | |
| 5,487,623 | A | 1/1996 | Anderson et al. | |
| 5,507,599 | A | 4/1996 | Anderson et al. | |
| 5,522,682 | A | 6/1996 | Egan | |
| 5,551,809 | A | 9/1996 | Forsberg | |
| 5,551,810 | A | 9/1996 | Franceski et al. | |
| 5,586,841 | A | 12/1996 | Anderson et al. | |
| 5,624,211 | A | 4/1997 | Anderson et al. | |
| 5,642,968 | A | 7/1997 | Anderson et al. | |
| 5,671,584 | A | 9/1997 | Mueller | |
| 5,778,622 | A | 7/1998 | Baker | |
| 5,795,106 | A | 8/1998 | Herd | |
| 5,807,030 | A | 9/1998 | Anderson et al. | |
| 5,860,771 | A | 1/1999 | Ditcher et al. | |
| 5,921,715 | A | 7/1999 | Rainey | |
| 5,975,810 | A | 11/1999 | Taylor et al. | |
| 6,050,748 | A | 4/2000 | Anderson et al. | |
| 6,050,749 | A | 4/2000 | Khamis | |
| 6,079,908 | A | 6/2000 | Anderson | |
| 6,089,792 | A | 7/2000 | Khamis | |
| 6,113,317 | A | 9/2000 | Myers | |
| 6,152,655 | A | 11/2000 | Hull | |
| 6,168,351 | B1 * | 1/2001 | Rainey | 405/262 |
| 6,224,295 | B1 | 5/2001 | Price et al. | |
| 6,238,144 | B1 | 5/2001 | Babcock | |
| 6,338,597 | B1 | 1/2002 | Rainey | |
| 2001/0014255 | A1 | 8/2001 | Orsat | |

* cited by examiner

*Primary Examiner*—Carl D. Friedman
*Assistant Examiner*—Jennifer I. Thissell
(74) *Attorney, Agent, or Firm*—Fredrikson & Byron, P.A.

(57) ABSTRACT

A stablized retaining wall structure comprising concrete blocks stacked in an array of superimposed rows, and with a stable anchoring assembly being in restraining contact with selected blocks. A retainer detent extends from the top surface of a wall of the block between the outer surface of the block and the hollow core. An earthen fill zone is arranged in spaced apart relationship to the rear surface of the retaining wall and clean granular back-fill is interposed between the retaining wall and the earthen fill zone. A retainer device is provided to couple selected wall blocks to a remote stable anchoring assembly, with the retainer device being configured to be restrainably held within the hollow core. One end of an elongated fastener is coupled to the retainer device, with the fastener extending outwardly through the retainer detent and secured to the remote stable anchoring assembly.

5 Claims, 6 Drawing Sheets

REINFORCING SYSTEM FOR STACKABLE RETAINING WALL UNITS

CROSS-REFERENCE TO RELATED APPLICATION

The present application is a continuation-in-part of our co-pending application Ser. No. 09/976,384, filed Oct. 11, 2001, entitled "REINFORCING SYSTEM FOR STACKABLE RETAINING WALL UNITS", assigned to the same assignee as the present application.

BACKGROUND OF THE INVENTION

The present invention relates generally to an improved system for stabilizing retaining wall structures, and particularly retaining wall structures which comprise a plurality of individual blocks stacked in an array of superimposed rows. More particularly, the present invention relates to improved connector devices which provide and facilitate attachment between selected individual blocks and a remotely positioned stable anchoring assembly. By way of explanation, the stable anchoring assembly may typically be in the form of a geogrid, mesh, deadman, or the like, with the anchoring assembly normally being disposed in on-site soils which typically contain corrosion inducing salts and the like.

Retaining walls are in general use for a wide variety of applications, including virtually any application where it is necessary to hold or retain earth to prevent erosion or undesired washing of a sloped surface or for general landscaping purposes. Examples of such applications further include retaining walls designed for configuring contours for various landscaping projects, as well as those for protecting surfaces of roadways, walkways, or the like from eroded soil and earth. Because of their physical structure and for protection of the wall from excessive hydrostatic pressures, the wall is normally separated from on-site soils by a buffer zone of clean granular backfill, such as, for example, crushed rock, binder rock, or the like. Such buffer zones assist in drainage, while at the same time assist in reducing hydrostatic pressure against the wall.

In order to achieve proper stabilization of the erected retaining wall, a geogrid, deadman, wire mesh system, or other anchoring means buried remotely from the retaining wall and disposed within the on-site soil is utilized to positionably stabilize, hold, or otherwise restrain individual blocks or groups of blocks forming the array against movement or motion. Selected blocks comprising the wall are coupled to the anchoring means. Various forms of coupling means have been utilized in the past, they have typically been designed to be captured within the block structure, and thereafter fixed directly to the anchoring means. Little, if any, length adjustment has been possible in the coupling means, thereby making the interconnection less than convenient. As such, the ultimate interconnecting operation can be time consuming due to the necessity of configuring coupling means to fit the block wall. Also in those coupling devices which are permanently fixed to the block, pallet stacking densities of blocks to be shipped may be reduced.

The present invention facilitates the interconnection process by utilizing a coupling means which includes a standard keeper frame together with elongated couplers of adjustable or assorted lengths. Individual blocks comprising the retaining wall structure are provided with a hollow core along with one or more retainer detents across and through an upper edge of the block surfaces to the inner wall of the core. This arrangement makes it possible to utilize standard block making equipment to create a single block structure which may be tightly palletized as any standard block design, with the block having a structure which facilitates secure attachment of the coupling means to individual blocks, with the coupling means being, in turn, produced conveniently in selective and appropriate lengths for ready attachment or fastening to the stable anchoring assembly. The configuration of the interconnect on the block structure is such that conventional and standard block-making equipment systems and processes may be utilized.

SUMMARY OF THE INVENTION

In accordance with the present invention, a coupling means for securing individual blocks in a retaining wall to a stable remote anchoring assembly. The coupling means includes a keeper device with an elongated transversely extending fastener means secured to the keeper frame, and with the opposed end being linked to the anchoring assembly. The individual blocks are hollow core structures having retainer detents extending inwardly from a top edge surface of the block, with the detents extending through the thickness of the walls in which they are formed. The retainer detents may be formed in the rear wall of a given block, an alternative may be formed inwardly from the top edge of the side walls. When formed in the rear wall, the retainer detents extend inwardly from the top edge of the rear of the block. The retainer detents extend downwardly into the web to an arcuate base pod at the top edge of the rear of the block to a point generally midway between the upper and lower edges of the block. When formed in the side walls, corresponding or aligned retainer detents are formed in parallel relationship inwardly from the top edge, and may, in these situations, conveniently extend inwardly a modest distance sufficient for retention purposes. In certain unusual retaining wall structures, the keeper frames and assemblies are designed to receive and retain the elongated fastener, with the next-adjacent superimposed row of blocks serving to further retain the keeper assemblies and elongated fasteners. The keeper frame is sized for retention within the block core, while various lengths of fasteners are provided to achieve and facilitate the interconnection between individual blocks and the stable anchoring assembly. The fasteners are preferably length adjustable in order to facilitate or accommodate taut or tight interconnects.

In this fashion, a stabilized retaining wall is formed with a universal coupler means being provided, the coupling means employing a keeper frame along with anchors and elongated couplers of a variety of lengths, preferably adjustable to join the stable anchoring assembly.

In an alternative arrangement, a supplemental anchoring or stabilizing "ladder" may be provided on the fastener means by attaching a number of spaced-apart parallelly arranged support rods, each being secured along an axis disposed generally at right angles to the axis of the elongated fastener means.

Therefore, it is a primary object of the present invention to provide an improved interconnection between individual blocks in a retaining wall structure and a remotely positioned or disposed stable anchoring assembly.

It is yet a further object of the present invention to provide an improved interconnection system for use in joining individual blocks of a retaining wall to a remotely positioned stable anchoring assembly such as, for example, a geogrid, wire mesh, or dead-man.

Other and further objects of the present invention will become apparent to those skilled in the art upon a study of the following specification, appended claims, and accompanying drawings.

IN THE DRAWINGS

Figure 6:
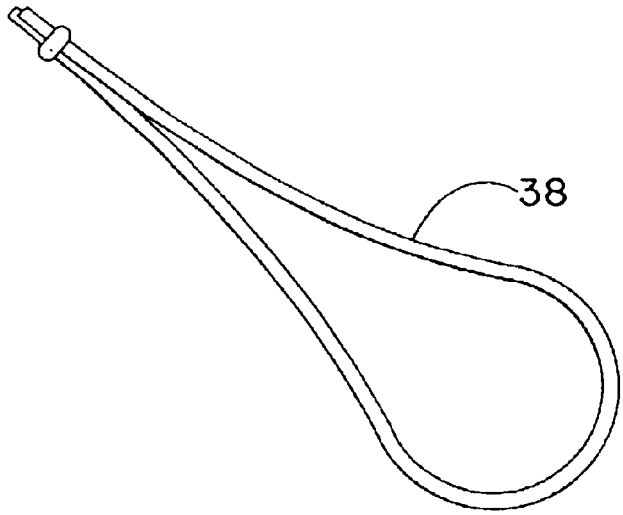
Figure 7:
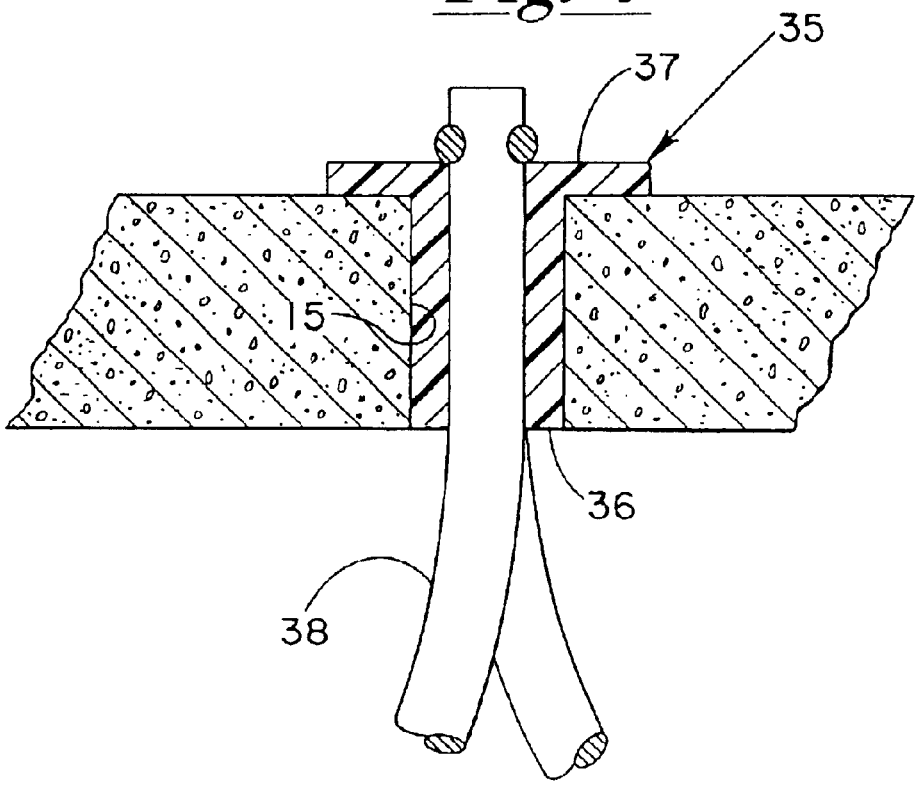

FIG. 6 is a detail elevational view of a further alternative embodiment of the coupling means and illustrating an elongated fastener being axially slidably engaged within a stopper element, with a portion of the elongated fastener being cut away; and FIG. 7 is a horizontal sectional view illustrating the arrangement detail of the locking sleeve utilized to retain the elongated fastener within the block structure.

Figure 1:
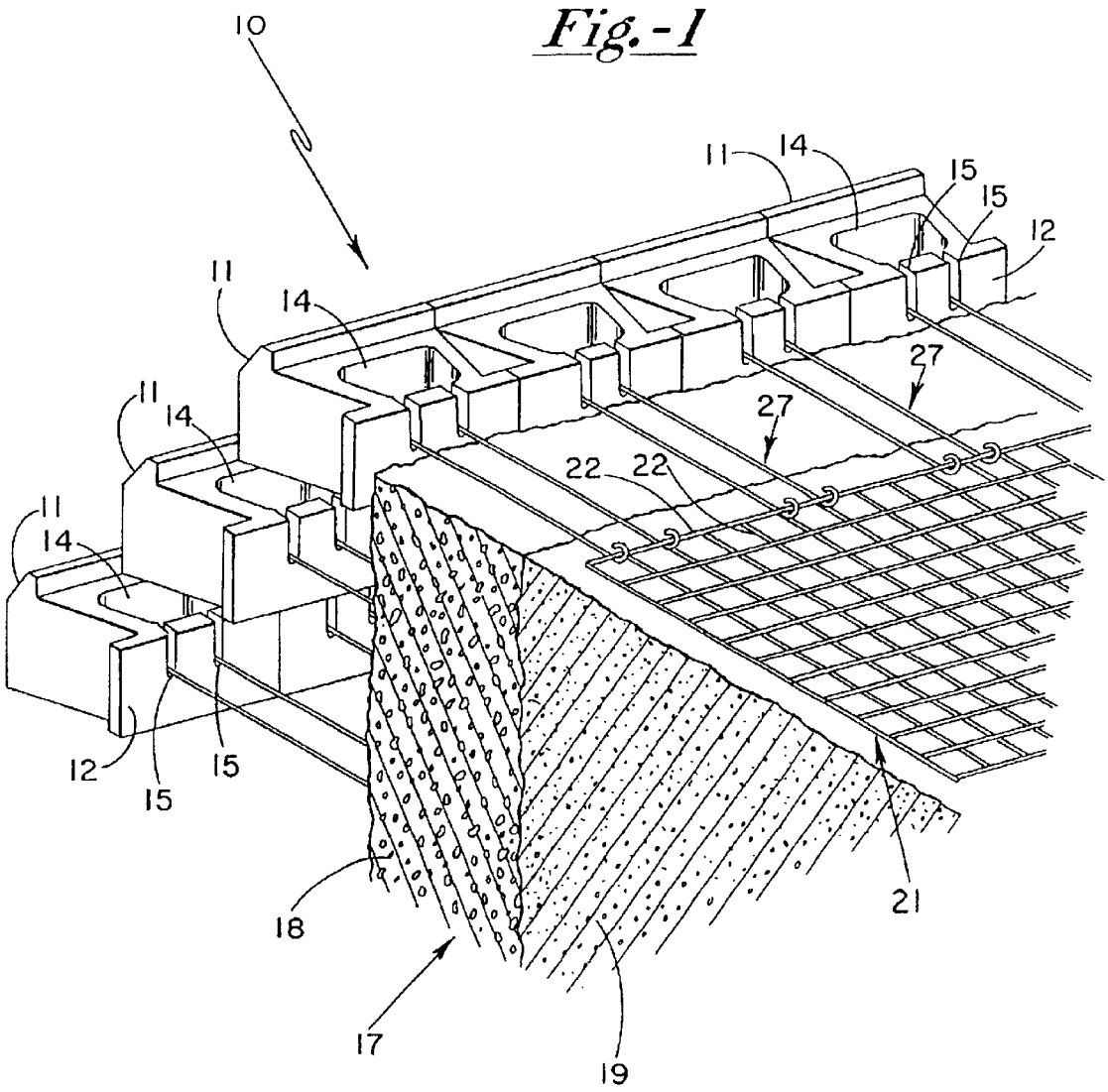
FIG. 1 is a perspective view of a stabilized retaining wall structure with a portion of the retaining wall being shown along a vertical sectional view.
Figure 2:
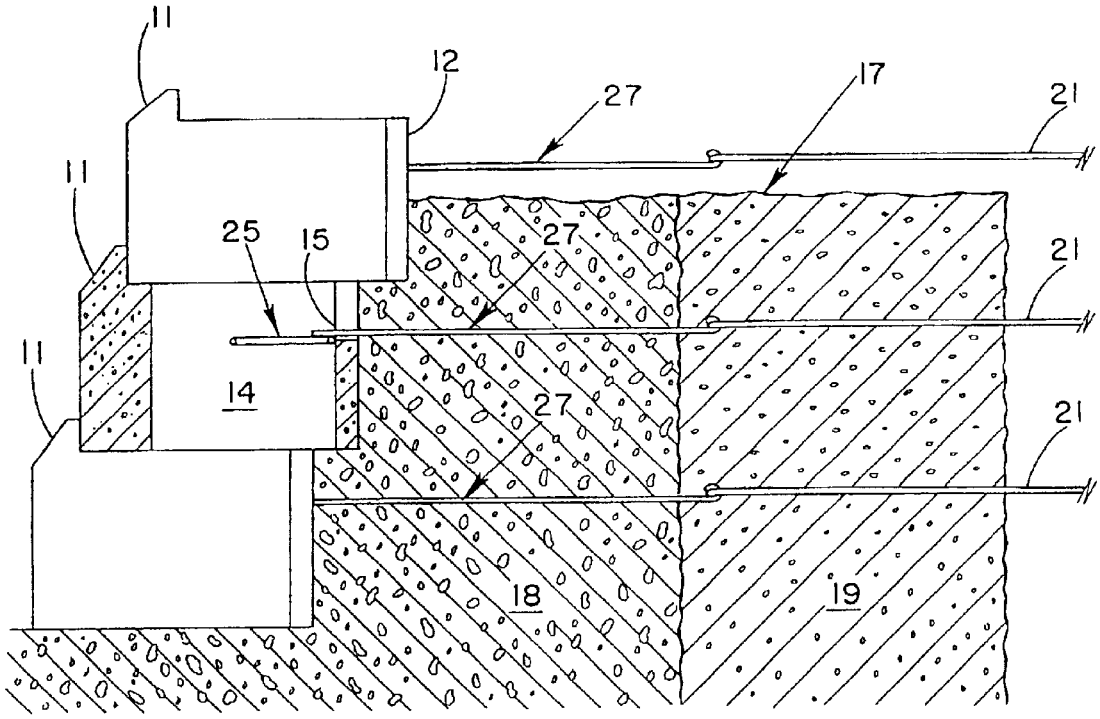
FIG. 2 is an end elevational view of a retaining wall block of the type illustrated in FIG. 1, and illustrating in phantom the disposition of the coupling means as attached to a stable anchoring assembly.
Figure 8:
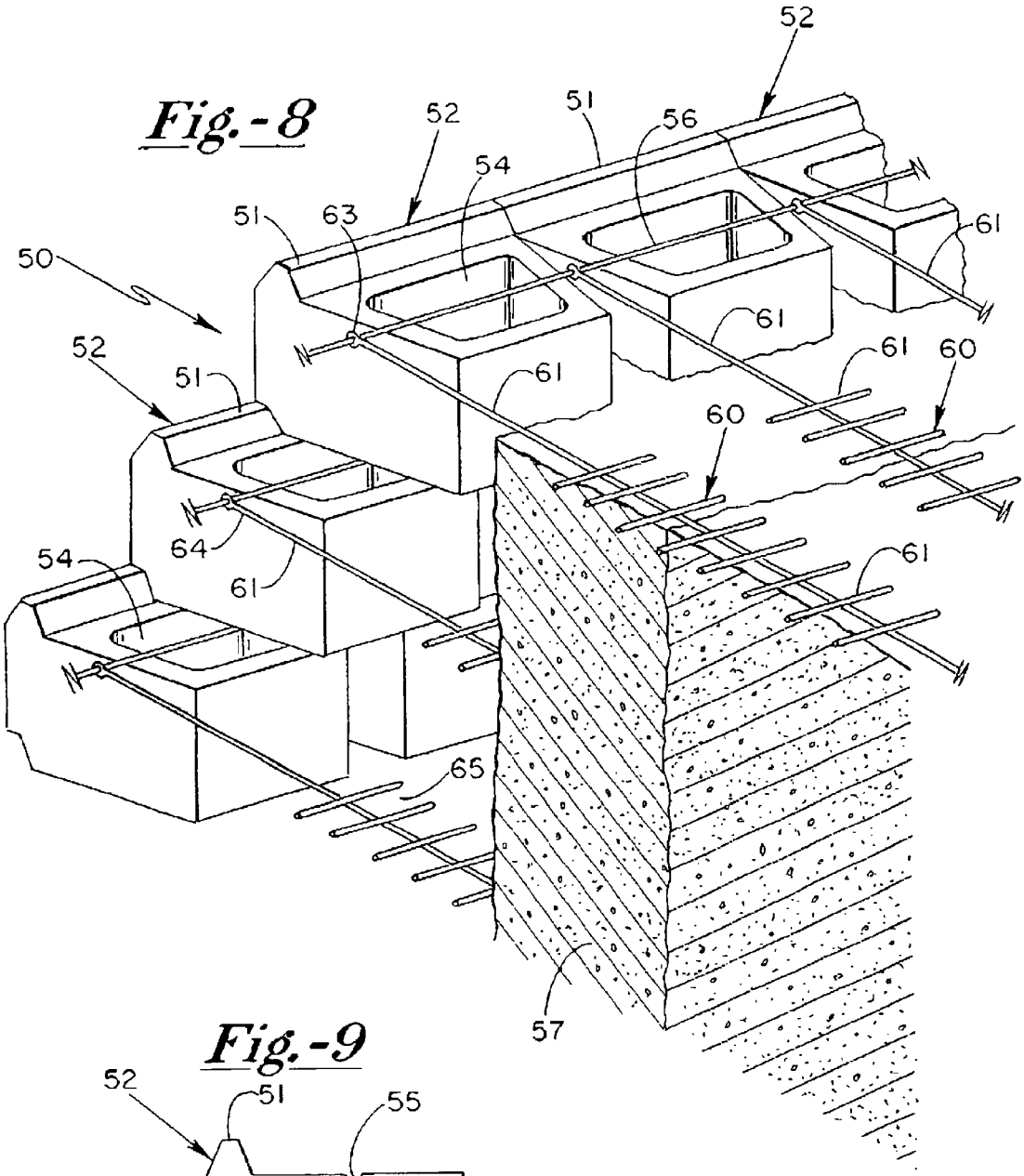
Figure 9:
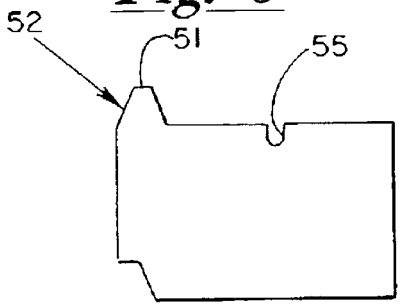
Figure 10:
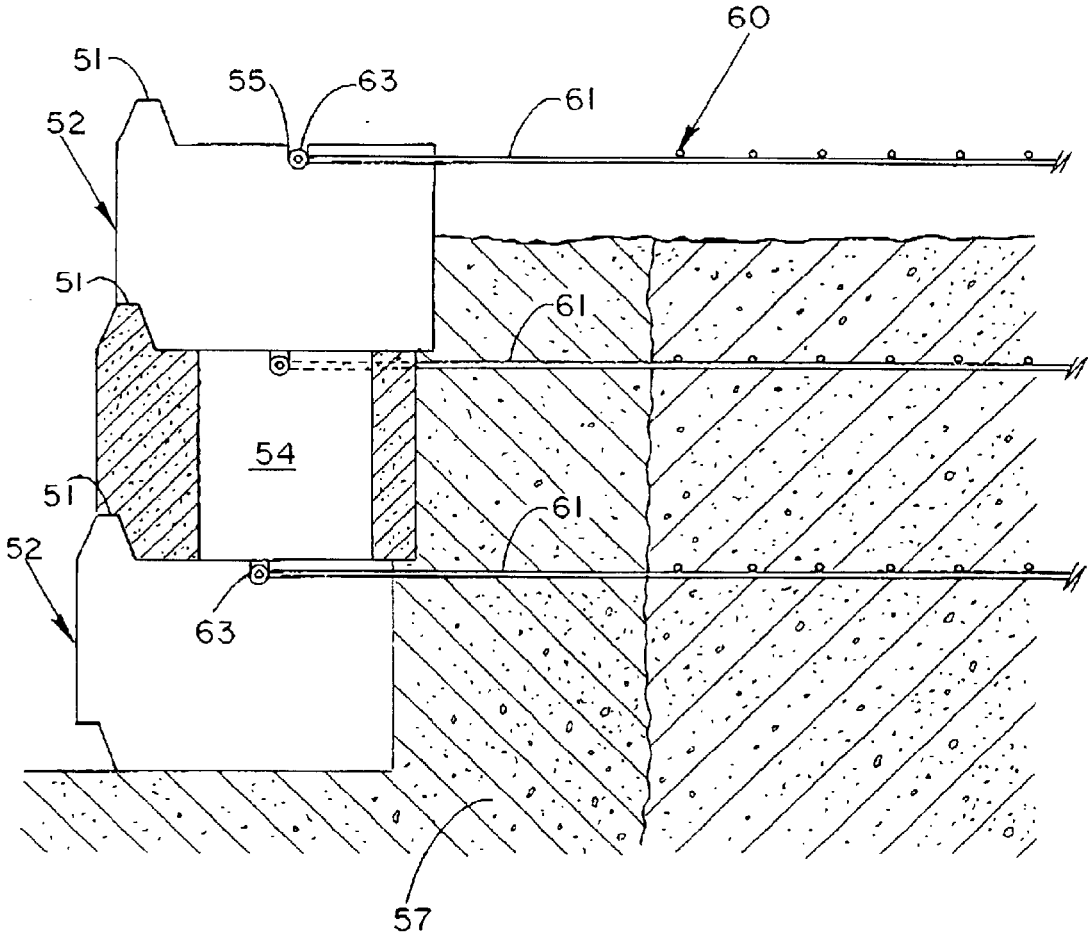

FIG. 8 is a perspective view similar to FIG. 1, illustrating the modified stabilizing system for retaining wall structure with a block structure having laterally disposed rod-gripping retainer detents therein with a portion of the overall assembly being shown along a vertical sectional view, and with an alternate form of retainer detent and fasteners being shown;

FIG. 9 is an end elevational view of the retaining wall embodiment illustrated in FIG. 8, and illustrating the disposition of the coupling means attached to an elongated rod extending along the longitudinal axis of the retaining wall block assembly; and FIG. 10 is an end elevational view of the retaining wall block of the embodiment of FIGS. 7 and 8, and showing the detail of the retainer detent.

DESCRIPTION OF A FIRST PREFERRED EMBODIMENT

In accordance with one preferred embodiment of the present invention, and with particular attention being directed to FIG. 1 of the drawings, the stabilized retaining structure generally designated 10 comprises a plurality of individual blocks 11—11 which are arranged in a plurality of superimposed rows to form a stacked array. Each of the blocks 11 has a rear surface 12 with a hollow core 14 being formed in at least selected of blocks 11. Retaining wall blocks of this configuration and/or form are known in the art.

Blocks 11 are provided with a retainer detent or access slot or opening 15 which extends through the block from the rear surface to the surfaces of the wall comprising the hollow core. Access slot 15 extends from the upper edge of the rear surface of the block to a point substantially midway between the top and bottom edges of the rear surface 12. Access slot 15 provides a slotted opening through the rear web of the block extending from the top edge to a point generally midway of the height of the block. Additionally, access slot 15 is made as narrow as possible in order to preserve the integrity of the block structure.

As further indicated in FIG. 1, a rock and earthen fill such as is illustrated generally at 17 is in contact with the rear surfaces 12 of the blocks 11, with fill 17 comprising a pair of individual or separate layers. The first layer 18 positioned adjacent wall 10 is preferably clean granular backfill, such as clean crushed rock or binder rock. The more remote layer 19 consists of on-site soils such as, for example, black earth, typically containing quantities of clay and salt. A stable anchoring assembly shown generally at 21 is disposed within the on-site soil, with assembly 21 being comprised of individual geogrid members shown at 22—22. Alternative forms of anchoring assemblies may be employed in lieu of geogrids 22, such as for example, steel, mesh, deadman, or the like.

Inasmuch as the on-site soils typically contain moisture and water soluble salts, galvanic or electrolytic corrosion typically occurs within metallic components buried or otherwise immersed in the soil. The galvanic corrosive action is accelerated and/or supported if the on-site soils are permitted to make contact with the rear surfaces of the individual blocks, with the area adjacent the blocks being characterized as the "corrosive front". Thus, deterioration of any metallic components disposed in close proximity to the interface between the block wall and on-site soils may suffer rapid deterioration. In order to reduce the level of activity of the corrosive front, and increase the life of metallic components disposed therearound, the utilization of clean granular fill has been found to be helpful but never sufficient to eliminate the problem. However, because of the nature and salt content of certain soils, taken together with the nature and content of salts inherently present in the individual blocks, coupling means may be provided to link individual blocks to the stable anchoring assembly which are non-metallic or include non-metallic components, and thus generally immune from corrosive action. In these situations, there nevertheless remains a need for clean granular backfill, particularly for reduction and/or elimination of hydrostatic forces which may otherwise develop if saturated on-site soils are permitted to remain in place and in contact with the retaining wall structure. In accordance with the present invention, however, the retaining wall is provided with additional stabilizing features through the utilization of coupling means which conveniently link the blocks to a remotely disposed stable anchoring assembly.

Figure 3:
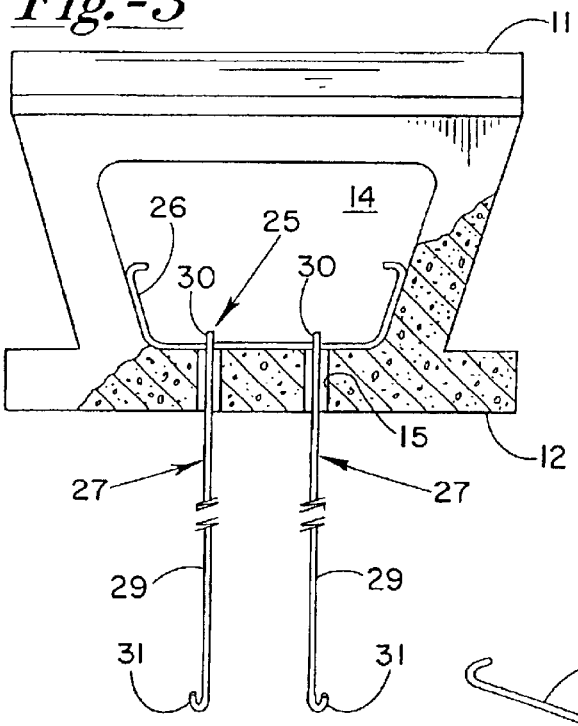
FIG. 3 is a top plan view of a block structure of the type illustrated in FIG. 1, and further showing one embodiment of the coupling means of the present invention in position within the core of the block.
Figure 4:
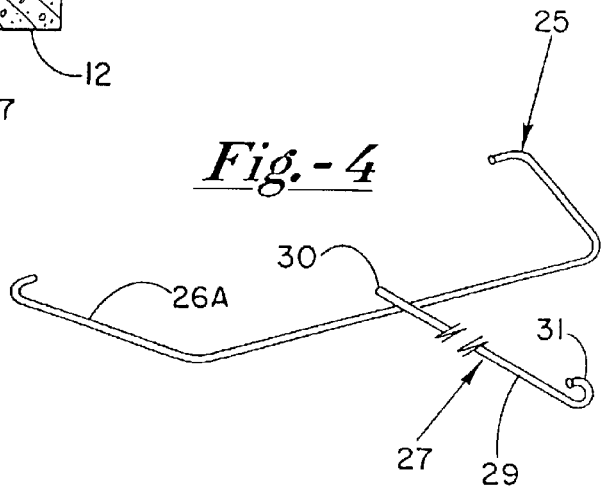
FIG. 4 is a detail perspective view of one preferred embodiment of the coupling means of the present invention.

With attention now being directed to FIGS. 3 and 4 of the drawings, the coupling means generally designated 25 comprises a retainer or keeper device 26 to which there are attached a pair of elongated fasteners as shown generally at 27—27 (see FIG. 3). In the alternative arrangement of FIG. 4, retainer device 26A is provided with a single fastener 27.

Each fastener 27 has a proximal end 30 and a distal end 31 comprises a central body segment 29 interposed between the proximal and distal ends. Body segment 29 extends through and distally of block 11, passing through access slot 15 formed in the rear web of block 11. Distal end 31 is configured to engage or otherwise be secured to a suitable anchoring point in one of the geogrids 22—22. Thus, distal end 31 comprises an anchoring assembly attachment means.

Figure 5:
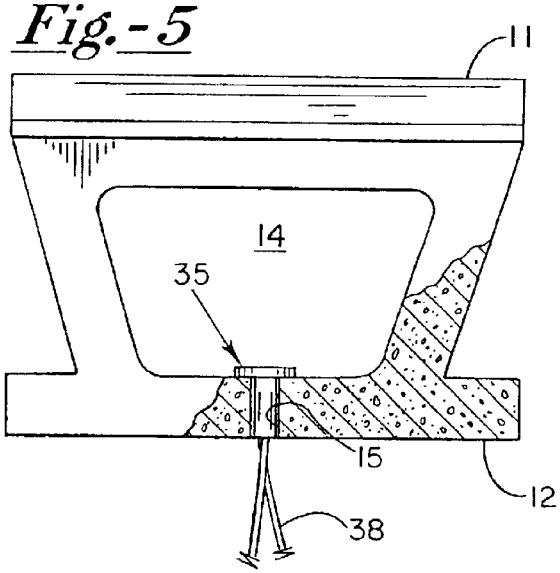
FIG. 5 is a view similar to FIG. 3, and illustrating an alternate form of coupling means secured within the block structure.

With attention now being directed to FIGS. 5 and 7 of the drawings, plastic sleeve generally designated 35 is provided, with sleeve 35 comprising a tubular segment 36 and a flanged segment 37, with flange segment 37 being sized so as to be larger than the diameter of access slot 15. Means are provided to restrain elongated fastener means 38 within plastic sleeve 35 by means of suitable retainers along the proximal end 30 of fastener 27. In the embodiment illustrated in FIGS. 5 and 7, elongated fastener 38 is in the form of reinforced flexible line or cable, which may conveniently consist of a non-metallic plastic resinous material such as nylon, or alternatively, steel cable. The utilization of sleeve 35 provides protection to the cable from abrasion which may otherwise be created through rubbing contact or other interaction with the concrete. The outer diameter of tubular segment 36 is, of course, sized to pass through access slot 15 while the flanged end is sufficiently large so as to be retained within core 14.

In those situations where the distance between the rear surfaces of various portions of the block wall and the anchoring assembly may vary, elongated fastener means 27 may more conveniently consist of a material such as reinforced nylon, which may be knotted and/or otherwise formed to length, whereby convenient attachment to geogrid or steel mesh may be achieved. In order to accommodate random length requirements of the fastener means, one convenient technique is to loop a length of line from the keeper device through an opening in the geogrid (or mesh) and then back to and through access slot 15, whereby the proximal end may be secured by a cable clamping device for a cable or a knot arrangement for materials such as reinforced nylon.

Alternative Preferred Embodiment

Attention is now directed to FIGS. 8, 9 and 10 of the drawings wherein a modified block structure is shown, the block having laterally disposed rod-holding retainer detents formed therein. As illustrated in FIG. 8, stabilized retaining structure generally designated 50 comprises a plurality of individual blocks 51—51 arranged in a plurality of superimposed rows to form a stacked array, with this view being similar to that of FIG. 1 with the exception of the individual retainer detents formed in the blocks. Each of the blocks 51 has a rear surface 52 with a hollow core 54 being formed in at least selected of blocks 51.

Blocks 51 are provided with a pair of laterally disposed retainer detents as at 55 which are disposed in axial alignment through side walls of each block 51 so as to provide a retainer pocket for elongated retainer rod member 56. Retainer detent or slot 55 is made as narrow as possible to accommodate the diameter of retainer rod 56, while at the same time serving to engage elongated retainer rod 56 and preserve the integrity of the structure of block 51.

As shown in FIG. 1, rock, earth and fill as at 57 is present and in contact with the rear surfaces 52 of blocks 51, and is otherwise similar to that fill used and described in connection with the embodiment of FIGS. 1–7.

With attention now being directed to the stable anchoring system shown generally at 60—60, it will be observed at this assembly comprises a series of fastener elements 61—61 which extend rearwardly of the individual blocks 51 in the end wall 50. Transversely disposed grid members 62—62 comprise steel ladders and are utilized to provide solid frictional engagement with the soil in order to form a stable anchoring assembly. Members 61—61 are, of course, preferably fabricated from the same metallic substance as elongated member 61 to avoid galvanic or electrolytic corrosion at the intersecting weld site. In a typical installation, fasteners 61 extend rearwardly a sufficient distance to provide adequate stability and stable anchoring for those blocks 51 comprising the stacked array 50.

As indicated in FIG. 8, members 61 are secured to elongated retainer rod 56 by means of an eyelet or the like as at 63. By way of example, eyelet 63 may be a closed loop or alternatively an elongated hook element which will permit members 61 to be reliably attached to elongated retainer rod 56. In other words, fastener elements or members 61 comprise an eyelet 63 or hook at the proximal end, a central coupling segment as at 64, and a body portion 65 distally thereof. Body portion 65 is the area or zone in which the steel ladder or grid members 62 are coupled. Thus, the combination of the grid members 62 with fastener means 61 comprise or create the steel ladder for the stable anchoring assembly.

Thus, it will be observed that the coupling means of the present invention provide a simple means by which a hollow core block may be positively connected to a stable anchoring assembly. Additionally, the coupling means may be used in a variety of applications to engage stable anchoring systems such as steel ladder structures as shown in FIGS. 8–10 inclusive, or to others such as geogrid reinforcements, a dead-man, or the like. Alternatively, certain soil nails may also be used. The connection means resist localized corrosion without requiring use of costly components such as those fabricated from stainless steel, coated steel, hot-dipped high carbon steel, or the like. Galvanic protection is readily achieved, without sacrificing versatility of coupling length.

It will be appreciated that various modifications may be made to the techniques of the present invention, it being further understood that the examples given herein are for purposes of illustration only and are not to be construed as a limitation upon the scope to which the invention is otherwise entitled.

What is claimed is:

1. In combination, a stabilized retaining wall structure comprising a plurality of individual blocks stacked in an array of superimposed rows each with front, rear and side walls, at least one hollow core being formed in selected of said blocks and with a retainer detent extending through one of the said rear or side walls of said block, with said retainer detent extending downwardly from the upper surface of the block to a point intermediate the height thereof, an earthen fill zone in spaced apart relation to said rear surfaces and clean granular back-fill interposed between said earthen fill zone and said rear surfaces, a stable anchoring assembly disposed in said earthen fill zone and being coupled to and in restraining contact with said selected blocks, and a coupling means comprising a retainer device disposed in the core of said selected blocks and engaged therewith for interconnection with said stable anchoring assembly, said coupling means further comprising:

a. an elongated fastener means with a body segment extending through and distally of said retainer detent, and with said distal end comprising an anchoring assembly attachment means;

b. said retainer device being configured to restrain the proximal end of said elongated fastener means within said retainer detent and said hollow core; and (c) said anchoring assembly attachment means being secured to said stable anchoring assembly.

2. The stabilized retaining wall structure of claim 1 wherein said elongated fastener means consists of a flexible cable.

3. The stabilized retaining wall structure of claim 2 wherein said flexible cable consists of polymeric resin.

4. The stabilized retaining wall structure of claim 1 wherein said retainer device comprises a metal bracket.

5. The stabilized retaining wall structure of claim 1 wherein said retainer device consists of a molded plastic plate.

* * * * *